US007892617B2

(12) United States Patent
Bathelier et al.

(10) Patent No.: US 7,892,617 B2
(45) Date of Patent: Feb. 22, 2011

(54) PANEL, IN PARTICULAR FOR FLOOR COVERING

(75) Inventors: Xavier Bathelier, Saint Pierremont (FR); Bernard-Andre Deconinck, Garches (FR)

(73) Assignee: Tarkett SAS (FR)

( * ) Notice: Subject to any disclaimer, the term of this patent is extended or adjusted under 35 U.S.C. 154(b) by 47 days.

(21) Appl. No.: 11/917,533

(22) PCT Filed: Jun. 13, 2006

(86) PCT No.: PCT/EP2006/063154

§ 371 (c)(1),
(2), (4) Date: Dec. 14, 2007

(87) PCT Pub. No.: WO2006/134109

PCT Pub. Date: Dec. 21, 2006

(65) Prior Publication Data

US 2008/0199676 A1 Aug. 21, 2008

(30) Foreign Application Priority Data

Jun. 14, 2005 (EP) ..... 05291280

(51) Int. Cl.
*B32B 21/00* (2006.01)
*E04F 15/00* (2006.01)
*E04F 15/04* (2006.01)

(52) U.S. Cl. ..... 428/57; 52/384; 52/390; 52/391; 52/578; 52/588.1; 428/53; 428/221; 428/223

(58) Field of Classification Search ..... 428/57, 428/53, 223, 221; 52/384, 390, 391, 578, 52/588.1
See application file for complete search history.

(56) References Cited

U.S. PATENT DOCUMENTS 3,579,941 A * 5/1971 Tibbals ..... 52/384
6,808,777 B2 * 10/2004 Andersson et al. ..... 428/47
2004/0031226 A1 2/2004 Miller et al.

FOREIGN PATENT DOCUMENTS

DE 201 22 032 12/2003
GB 2 377 457 1/2003

OTHER PUBLICATIONS

International Search Report; PCT/EP2006/063154; Oct. 10, 2006.

* cited by examiner

*Primary Examiner*—David R Sample
*Assistant Examiner*—Brent T O'Hern
(74) *Attorney, Agent, or Firm*—Cantor Colburn LLP

(57) ABSTRACT

Disclosed is a surface covering panel including a first edge with a groove inclusive first coupling means, a second opposite edge with a tongue inclusive second coupling means, the coupling means enabling coupling of two panels, a mechanical locking means integrated into at least one of the coupling means which, when two panels are coupled, is configured to prevent these panels from moving apart, the coupling means being designed for coupling essentially without elastic deformation, wherein at least one part of the surface of at least one of the coupling means includes a repositionable adhesive configured to create bonds between the coupling means that are multiply breakable and re-bondable, wherein a breaking of the bonds on disassembly of the panels results in a chemical click designed to indicate decoupling to a user.

22 Claims, 3 Drawing Sheets

PANEL, IN PARTICULAR FOR FLOOR COVERING

This application is the national stage entry of PCT/EP2006/063154 filed Jun. 13, 2006.

FIELD OF THE INVENTION

The present invention relates in general to surface covering panels. It relates more particularly to "floating" flooring systems and in particular panels, commonly known as strips or boards, for producing such flooring systems.

BACKGROUND OF THE INVENTION

Floating flooring systems have been increasing considerably in popularity in recent years. Unlike nailed or glued flooring systems, the laying of which is difficult and has to be left to specialists, a particular advantage of floating flooring systems is their ease of installation (on an existing floor covering of the carpet, ceramic tile or vinyl type or directly onto a stone floor).

As is known, flooring strips are conventionally provided on their edges with tongue and groove coupling elements which are intended to join two adjacent strips together by interlocking during assembly of the flooring system.

Among the various systems which have been proposed for interlocking flooring strips intended for the production of floating flooring, those which have met with the greatest success among consumers and have consequently become so prevalent that they will doubtless shortly displace all other systems, are those known as "angular interlocking" systems. In these angular interlocking systems, two flooring strips are joined together by engaging the strip to be assembled at a certain angle (generally 45°) relative to the strip which has already been laid and then imparting to this strip a rotational movement having an axis which approximately coincides with the edges, which are in contact, of the tops of the strips, to bring it into the assembly plane.

Such a system is described, for example, in U.S. Pat. No. 4,426,820 granted to Heinz Terbrack. The flooring strips are rectangular in shape and are designed to be assembled by interlocking their opposing lengthwise edges. In order to do this, one edge is provided with a first coupling element comprising a groove and the other with a second coupling element comprising a tongue which is intended to cooperate with the first coupling element of an identical flooring strip. Mechanical locking means are incorporated into said coupling elements so as, when two flooring strips are mated in the assembly plane, to prevent these flooring strips from moving apart from one another in a direction perpendicular to that of said edges and parallel to the assembly plane. According to the coupling profile presented in U.S. Pat. No. 4,426,820, the groove of the first coupling element is defined by an upper lip and a lower lip. The lower lip extends beyond the upper lip and comprises a projecting locking element. The second coupling means comprises, in addition to the tongue which engages in the groove of the first coupling means, a locking channel which cooperates with the projecting locking element in order to immobilise the strip in the transverse direction.

Many improvements have since been suggested by manufacturers, the most useful of which is commonly known as the "click" system. The "click" system describes partial immobilisation of the strips relative to one another after assembly which is intended to hold them firmly together by preventing rotation in the uncoupling direction: if an attempt is made to detach the most recently inserted strip, it will only be detached if a certain force is applied. This partial locking has 2 advantages:

- It facilitates the actual laying. This is because, before assembling the strips of the most recent row by their large sides with the flooring being laid, it is convenient to assemble them to one another by their small sides (which have identical profiles to the large sides) and to hold them in place with wedges. The "click" effect acting on the small sides makes it possible to fasten together the row of strips, to limit the number of wedges to be used and so facilitate insertion of the complete row.
- It allows the user to be sure that all the strips are perfectly engaged in one another since they become firmly connected as a result of the "click". In this way, it acts to a certain extent as an assembly indicator. This function is of genuine importance, essentially in the case of laminated products based on MDF (medium density fibreboard) or HDF (high density fibreboard) of low thickness (e.g. 6 mm) where the grooving is shallow and the projecting parts fragile.

This partial immobilisation effect is achieved by generating friction, and more specifically by exploiting the elasticity of the material at the end of rotation during assembly of the boards.

Such a click system is described, for example, in patent EP 1 026 341 B1 held by UNILIN. In this system, the coupling elements are equipped with means which, once inserted into one another in two adjacent flooring strips, exert a mutual tension force which forces the strips towards one another. This is achieved by a particular configuration of the locking channel and the locking projection, which, in the assembled state, brings about an elastic deformation of the lower lip of the first coupling element and so generates the desired tension force.

Thus, in known systems, the "click" effect is typically the result of loading the intrinsic elasticity of the constituent materials of the strips. Furthermore, the forces in play during the click action will place a greater or lesser load on the strip at the point where it is generally at its thinnest.

Finally, it should be noted, and this is quite obvious from the interest aroused by this system, that this effect is all the more worthwhile the more marked it is.

It may therefore readily be understood that, in the case of thin products, for example of the HDF type, it becomes tricky to reconcile the strength of the material with the intensity of the "click" effect. This is because, for such materials, the thickness of the strip may be less than one mm.

OBJECT OF THE INVENTION

There is accordingly a need for flooring strips of the angular interlocking type which have a "click" effect which makes it possible to verify that the strips are firmly joined together during laying of flooring but which does not involve a risk of damaging the flooring strips.

GENERAL DESCRIPTION OF THE INVENTION

According to the invention, this aim is achieved by a panel according to claim 1.

The panel according to the present invention makes use of coupling elements designed for angular interlocking essentially without elastic deformation which are comparable in this respect to those of the conventional Terbrack system. According to one important aspect of the invention, at least one of the coupling elements is provided with a repositionable adhesive in order to fasten together two identical panels joined by their respective coupling means. In this manner, angular interlocking with a "click" effect is obtained essentially without elastic deformation of the coupling elements and the panels, so enabling assembly/disassembly of the panels without jeopardising their integrity.

The term repositionable adhesive conventionally denotes adhesives having an adhesive strength, generally known as stickiness or tack, which is sufficient for immediate adhesion on loading. Such adhesives allow the bond to be made and broken many times, normally without any reduction in tack. A repositionable adhesive exhibits tack which is generally weaker than that of permanent glues and no increase in adhesive strength occurs after contact.

On interlocking, the repositionable adhesive makes it possible to fasten the panels together immediately, i.e. to immobilise them one relative to the other. The fact that the panels become fastened together is an indicator for the user of proper interlocking; the assembly may then be handled without risk of separation. If the user wishes to separate the assembled panels, he/she will have to overcome the adhesive strength of the glue. In practice, the user will feel a resistance to separation of the panels reminiscent of that of "click" systems involving elastic deformation.

The present invention accordingly relates to a panel for covering surfaces, the coupling elements of which are designed to enable use similar to known "click" systems. However, the panel according to the present invention is provided with a "chemical click" system which, unlike known "mechanical click" systems, is not based on elastic deformation of the coupling elements, but instead on locking (immobilisation of the respective coupling means one relative to the other) due to the physico-chemical properties of the materials in contact.

According to a preferred embodiment, the first coupling means comprises an upper lip and a lower lip defining the groove, the lower lip extending beyond the upper lip. Furthermore, the mechanical locking means comprise:

a projecting locking element towards the top of the lower lip, the locking element having a first locking surface; and a second locking surface on the second coupling means, which surface is capable of cooperating with the first locking surface of a similar panel to prevent displacement perpendicular to the edges and parallel to the assembly plane.

In this variant, the locking element is preferably located on the lower lip beyond said upper lip in the direction perpendicular to the edge. The second locking surface is then defined by a locking channel in the second coupling means, behind the tongue.

The first locking surface, preferably planar, may have a locking angle of between 35 and 70° relative to the horizontal. The larger the angle, the better the transverse immobilisation.

Typically, for angular interlocking, the coupling means are designed such that the tongue of a first panel may be inserted, with a certain inclination, into the groove of a second panel, and that the stop of the second panel may be inserted into the locking channel of the first panel by a relative rotational movement between these panels about an axis of rotation corresponding to the tops of the edges in contact. Advantageously, the repositionable adhesive is provided on surfaces of the coupling means which are only placed under load at the end of the rotation during assembly, so immediately fastening the strips together and not hindering interlocking.

In order to disassemble two adjacent panels, the adhesive strength of the repositionable adhesive will have to be overcome. In the present document, "uncoupling moment" describes the moment which has to be overcome to initiate rotation of a panel in the disassembly direction. Preferably, this disassembly moment is of the order of 3 to 9 N·m/m, more preferably approximately 6 N·m/m. These values are of the order of magnitude of those observed with the "mechanical click" systems.

The "click" effect of the panels according to the invention may be adjusted in various ways. In particular, it is possible to act on the following parameters: tack of the adhesive; geometry/profile of the coupling means; shape of the adhesive deposit; number and position of adhesive deposits.

Tack is a function of the repositionable adhesive (glue) selected. In the light of the desired disassembly moment, repositionable adhesives with a predetermined tack of between 0.05 and 0.30 N/mm$^2$, more preferably of the order of 0.15 N/mm$^2$, are typically used. It goes without saying that tack here means the tack of the adhesive towards the panel which will come into contact with the adhesive during assembly and not the adhesive strength of the adhesive relative to the surface of the coupling means onto which it has been applied.

The repositionable adhesive selected preferably exhibits excellent adhesion to material constituting the panel (typically HDF, MDF or wood for producing flooring) during processing and thereafter retains a level of tack which will enable it to adhere partially to these same materials or to other materials of the polymer type (tack always remaining lower than adhesion during processing). The repositionable adhesive must, of course, exhibit immediate adhesion when placed under load and allow a large number of assembly/disassembly operations. A variety of repositionable glues is available and a selection may appropriately be made on the basis of the materials, the desired tack, the method of application, etc.

Hot-melt glues are particularly preferred, in particular due to their ease of processing. Application will be in the form of beads at desired points on the coupling means. Preferably, hot-melt glues will be selected which allow the formation, after cooling, of beads which exhibit hardness (and cohesion) sufficient to prevent the glue from flowing towards the other panel on disassembly.

Advantageously, the repositionable adhesive is provided on surfaces of the coupling means which are only placed under load at the end of interlocking (end of rotation) during assembly, so immediately fastening the panels together and not hindering interlocking.

Furthermore, the repositionable adhesive may be positioned on facing surfaces of the coupling means which are not in contact when the panel is coupled to an identical panel. It will therefore advantageously be possible to provide beads of glue on non-functional surfaces (which have neither an alignment nor locking function) of the coupling means, such as for example at the level of assembly clearances.

Such an assembly clearance is typically present behind the locking element which comprises surfaces facing the locking channel which are slightly spaced apart. These surfaces are not normally in contact with other surfaces during interlocking. The rear surface of this locking channel, which differs from the second locking surface, is therefore advantageously provided with one or more deposits of repositionable adhesive.

Positioning of the adhesive on the second coupling means, and in particular in the locking channel, enables restricted exposure of the adhesive deposits and so avoids degradation thereof (dust or other).

In order to prevent moisture rising up from beneath the panels, a deposit of repositionable adhesive will advantageously be provided in a lower part of the second coupling means. Such a deposit may also be provided in the upper part of the coupling means to prevent penetration of moisture from the upper face of the panels.

As indicated, the geometry of the profile has an influence on the click effect. In this context, it will be noted that a maximum disassembly moment may be obtained when the adhesive adheres to a surface of the locking element which is in a plane passing through the axis of rotation on decoupling. In general, the surfaces of the coupling means provided with a deposit of repositionable adhesive or which come into contact with the adhesive in the assembled state are preferably planar.

It will be noted that the adhesive deposits are preferably provided directly on the material constituting the panels, for example HDF or MDF, and that these deposit It will also be noted that the surfaces of the coupling means which will come into contact with an adhesive deposit may be made from a material which differs from that of the remainder of the coupling means. These surfaces could, for example, be covered with a polymer. This may make it possible to avoid any accumulation of particles from the material constituting the panel on the adhesive on disassembly.

The panel according to the invention has been particularly developed for covering floors and in particular for producing flooring. It may therefore have the conventional shape (rectangular or square) of a flooring strip. Conventionally, the first coupling means will therefore be provided on a small and a large side, and the second coupling means will be provided on the other small and large sides. The deposits of repositionable adhesive are then advantageously provided on the coupling means of the small and large sides.

Depending on the particular application, the shape of the panels and the number of edges may vary (e.g. polygonal shape), and the coupling means will be distributed appropriately.

The panel according to the invention may be manufactured straightforwardly using conventional methods, whether from solid wood, laminate or multilayer material. The repositionable hot-melt glue may, for example, readily be applied by guns at the predefined points on the coupling means once the latter have been machined.

However, the panel according to the invention may be used for covering surfaces other than floors, such as walls or ceilings. The panels may therefore be made from various materials depending on the application.

In this context, it will be appreciated that the panel according to the invention makes it possible to achieve a "click" effect even with materials which, unlike wood, HDF or chipboard, do not have any real elasticity. Such materials, which may for certain applications prove to be serious competitors to HDF, are for example fibre cements or certain highly filled resins which can readily be machined (in order to produce an angular interlocking profile) but have no elasticity.

In many applications, the panel according to the invention may have a multilayer structure, generally of the type: upper layer/support layer/backing (if necessary). For flooring, the upper layer may be of solid wood glued onto the support or made from a melamine-impregnated decorative sheet (imitating wood or other materials such as stone, ceramics, etc.). The support layer may be a particle board (MDF, HDF, chipboard), or made from wooden battens. Depending on the application, the upper layer may be of ceramics or polymer. Furthermore, as mentioned above, the support may be of fibre cement or resin, or other readily machinable materials.

DESCRIPTION OF THE DRAWINGS

Other details and characteristics of the invention will emerge from the detailed description of an advantageous embodiment given below by way of illustration with reference to the appended drawings, in which.

DETAILED DESCRIPTION OF A PREFERRED EMBODIMENT

Figure 1:
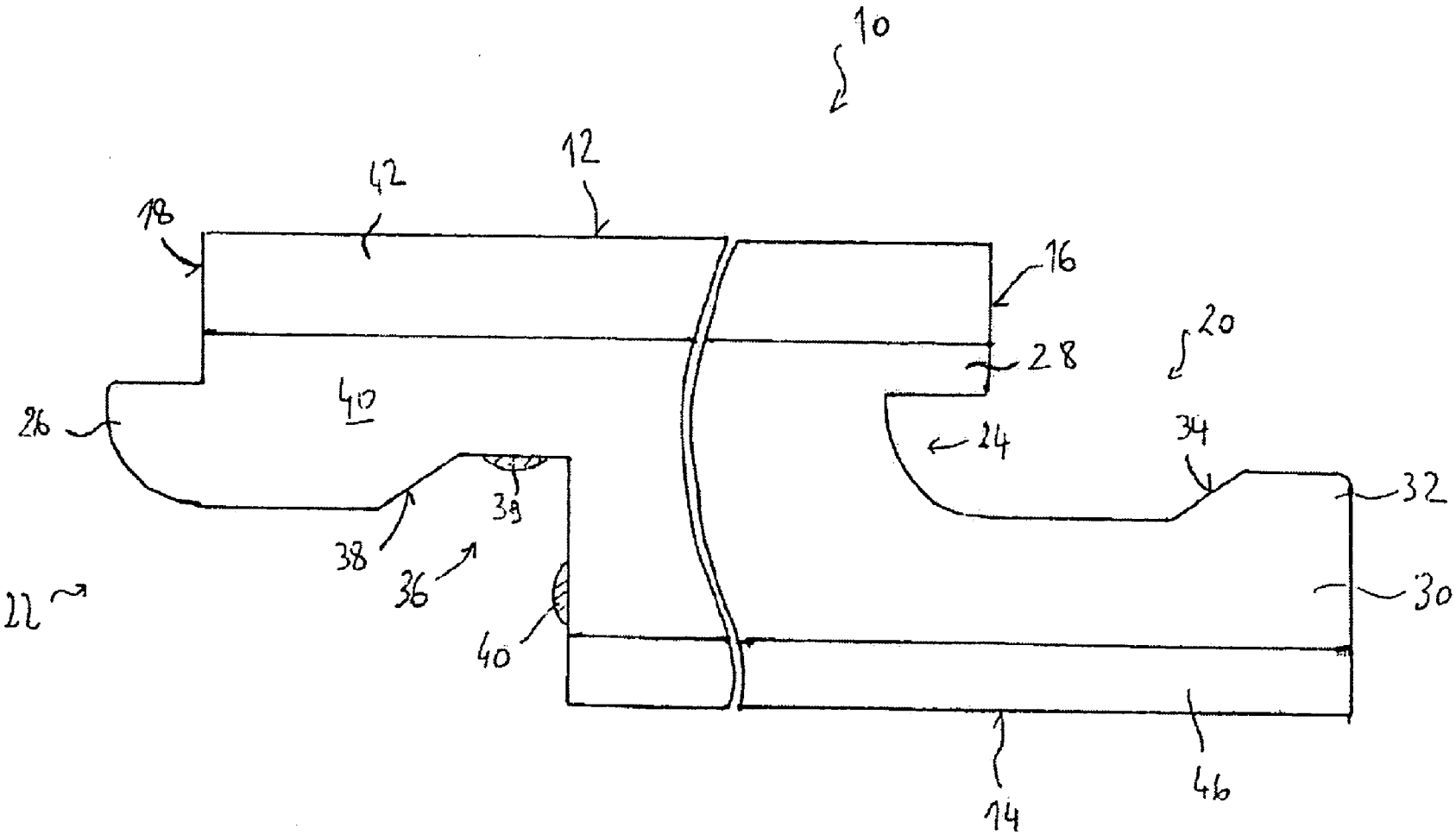
FIG. 1: shows a cross-sectional view of a preferred embodiment of a floor covering panel according to the invention.

FIG. 1 shows a cross-sectional view of a preferred embodiment of a panel 10 according to the invention. In the present variant, the panel 10 is a floor covering panel for producing floating flooring. This panel, which is commonly known as a strip or board, is generally rectangular in shape and conventionally comprises an upper face 12, an opposing lower face 14 intended to rest in the assembly plane, together with two opposing lengthwise edges 16 and 18 respectively provided with coupling means 20 and 22 to be joined to other similar panels. The small sides are also provided with such coupling means.

The first coupling means 20 comprises a groove 24 and the second coupling means 22 is provided with a tongue 26. Conventionally, these coupling means 20 and 22 are designed so as to be able to cooperate together for assembling the panel 10 with other panels of this type.

The groove 24 of the first coupling means is defined by an upper lip 28 and a lower lip 30 which extends beyond the upper lip 28 in the direction perpendicular to the edge 16.

Mechanical locking means are incorporated into the coupling means 20 and 22, such that, when the panel 10 is coupled to another identical panel in the assembly plane, these locking means prevent the two panels from moving apart from one another in a direction perpendicular to that of the edges 16, 18 and parallel to the assembly plane. In the present variant, the locking means comprise a locking element or stop 32 projecting upwards on the lower lip 30, said stop 32 defining a first locking surface 34. The locking means furthermore comprise a locking channel 36 in the second coupling means 22, which channel comprises a second locking surface 38. As for the tongue 26 and the groove 24, the stop 32 and the channel 36 preferably extend over the entire length of the edges.

As shown in the figures, the stop 32 is located on the upper side of the lower lip 30, beyond the upper lip 28 and therefore outside the groove 24. The channel 36, on the other hand, faces downwards and is located behind the tongue 26. The stop 30 and channel 36 are designed such that, when coupled (FIG. 3), the first and second locking surfaces 34 and 36, are in contact to immobilise the assembled panels in the transverse direction of the panels parallel to the assembly plane. To ensure effective locking, the two locking surfaces are planar and are preferably located in the same plane which form an angle α (known as locking angle) with the assembly plane (lower face 14 of the panel 10). This angle α may be of the order of 35 to 70°.

The coupling means are therefore designed so as to enable angular interlocking. Interlocking of two identical panels is shown in the FIG. 2, where a second identical panel 10' is joined to the panel 10 which rests in the assembly plane. For this coupling, the panel 10' is served up at a certain angle of inclination and it is handled so as to insert its tongue 26' into the groove 24 of the panel 10. The tongue 26' is therefore gradually inserted into the groove 24 by moving the panel 10' and by adjusting its inclination, until the tops of the edges come into contact at A. A downward rotational movement is then imparted to the second panel 10', which movement is on an axis passing through A, to bring the second panel 10' into the assembly plane and so engage the stop 30 of the first panel 10 in the channel 36' of the second panel 10'.

According to one important aspect of the present panel 10, the coupling means are advantageously designed such that during coupling and then once two adjacent panels are joined by their respective coupling means, there is essentially no elastic deformation.

Another important aspect is the presence of one or more deposits of repositionable adhesive on a surface portion of at least one of the coupling means 20 and 22. This enables immediate adhesion between the edges of two adjacent panels during assembly and so allows handling of the panels without their decoupling; however, the repositionable nature of the adhesive permits subsequent separation (decoupling) of two adjacent panels by applying a certain force. The panel according to the invention is therefore provided with a "chemical click" system obtained by this repositionable adhesive, which provides the same convenience of use as known "mechanical click" systems, while not giving rise to elastic deformation of the coupling means.

A repositionable adhesive (glue) is advantageously used which exhibits excellent adhesion to the material constituting the strip (generally HDF, MDF or wood) during processing thereof and which subsequently retains a residual adhesive power (tack) which will enable it to adhere partially to these same materials or to other materials of the polymer type, this residual bonding power always being lower than the adhesion during processing). This type of glue is sometimes known as "residual tack glue" or tacky adhesive. A variety of repositionable glues is available and selection may conveniently be made on the basis of the materials, the desired tack, application method, etc.

In the present variant, coupling is based on the conventional Terbrack profile as presented in U.S. Pat. No. 4,426,820 and which thus did not provide for elastic deformation of the coupling elements. As may be seen on FIG. 3, the vertical alignment between two adjacent panels is thus obtained by groove/tongue interlocking. In order to achieve this, there are two "functional" contact zones:

- between the tongue 26' and the upper lip 28 inside the groove 24;
- between the tongue 26' and the lower lip 30 on the outside of the groove 24 and in front of the stop 32.

Once assembled, retention in the transverse direction is provided by the locking means and there are two other functional contact surfaces:

- at the level of the tops of the edges; and
- between the locking surfaces 34 and 38.

Figure 3:
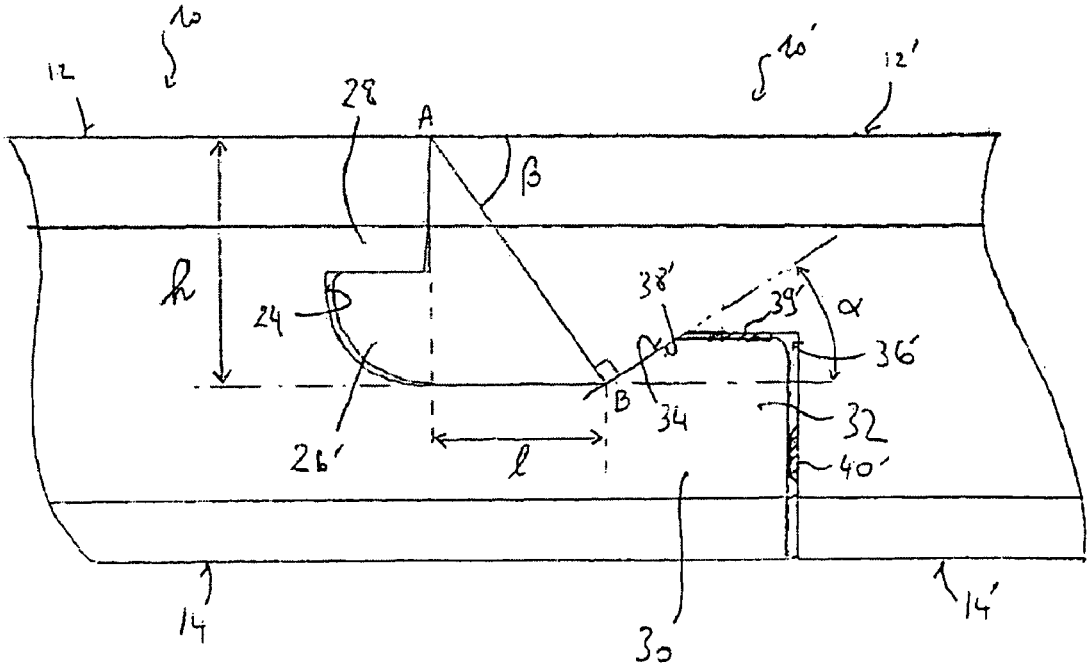
FIG. 3: shows a view of the two assembled panels.

Making reference to FIG. 3, a more detailed examination of the profile of the coupling means will make it possible to see how to distinguish between coupling without elastic deformation and coupling with elastic deformation. It will be understood that, with such a profile, one condition for engagement without deformation of the coupling means is that the locking surfaces 34 and 38 do not resist the rotation required for angular interlocking. Starting from the principle that the axis of rotation during coupling passes through the point A of contact between the tops of the edges, it would appear that interlocking by rotation without resistance can only be achieved if the locking angle α is no greater than the gradient of the tangent to the circle AB at point B. In the light of dimensions h and l shown on FIG. 3 and the angle β between segment AB and the upper surface of the panel, the following relationship is obtained:

$$\alpha \leqq 180° - \arctan(h/l)$$

In the present variant, this condition is satisfied since the angle α is tangent to the circle of radius AB at point B. A smaller angle α would thus meet the same requirement, but it is worthwhile to have the largest possible locking angle α in order to improve transverse locking.

As indicated above, the profile of the coupling means of the panel 10 comprises a certain number of functional contact zones. Outside these functional zones, there is no requirement for the coupling means to be in contact. This is for example the case in the rear part of the stop 32, where assembly clearance is preferably provided.

In the present variant, the repositionable adhesive is provided in this non-functional zone behind the stop 32, where it is applied in the form of beads which preferably extend over the entire length of the edge: a bead 39 or 39' at the bottom of the channel 38 and a bead 40 or 40', in the lower part of the second coupling element 22. The thickness of the bead corresponds to (or is slightly larger than) the clearance between the coupling means, such that on completion of assembly the beads 39, 40 are slightly crushed between the corresponding surfaces of the coupling means 20 and 22. This slight crushing of the bead improves the adhesion of this type of glue which generally exhibits a certain sensitivity to pressure.

It will also be noted that the adhesive deposits 39, 39', 40, 40' are preferably provided on planar surfaces of the channel 36, and that the surfaces of the stop 32 which will come into contact with the adhesive deposits are also planar. Furthermore, whereas in the present variant the adhesive deposits 39, 39', 40, 40' come directly into contact during assembly with the material constituting the stop 32, an appropriate polymeric coating could be provided on this stop 32 in order to prevent the bead from removing some particles from the stop during disassembly (something which could be of interest for certain materials).

It should be noted that immobilisation of the panels by the adhesive is achieved without effort, or only with a minimal effort ensuring close contact of the adhesive with the material facing it. It is the physico-chemical properties of the materials in contact which ensure the immobilisation of the panels, which are thus not subjected to any severe stresses likely to damage the coupling means or more generally the panel. The particular nature of repositionable glues allows a large number of coupling and decoupling operations without their effectiveness being degraded.

The desired "click" effect may be adjusted by acting on the following parameters: tack of the adhesive; geometry of the coupling profile; position of the adhesive bead(s); shape and dimensions of the adhesive bead; and number of beads. It will be understood that the important factor for the click effect is the tack relative to the surface which comes into contact with the adhesive deposit during interlocking and not the adhesive strength relative to the material onto which the adhesive deposit was applied.

Preferably, these various parameters will be acted upon in order to obtain a "click" effect on disassembly of the panels according to the invention which is similar to a mechanical "click" effect. A series of measurements carried out on various known "mechanical click" systems revealed that the average moment to be exerted to separate two neighbouring strips is of the order of 6 N·m for an edge length of 1 m (stated as 6 N·m/m)

The various parameters stated above will thus be acted upon to ensure that adhesion between two panels according to the invention is such that a moment (known as disassembly moment) of between 3 and 9 N·m/m, more preferably of the order of 6 N·m/m, is required for initiate rotation of a panel out of the assembly plane.

Such a disassembly moment may be achieved with repositionable glues having a tack of between 0.05 and 0.3 $N/mm^2$, preferably of approximately 0.15 $N/mm^2$.

It will be noted, by way of comparison, that if the panel 10, 10' had not been provided with deposits of repositionable adhesive, the disassembly moment of this panel would solely be a function of its weight, since the coupling profile is not deformed during disassembly.

Figure 2:
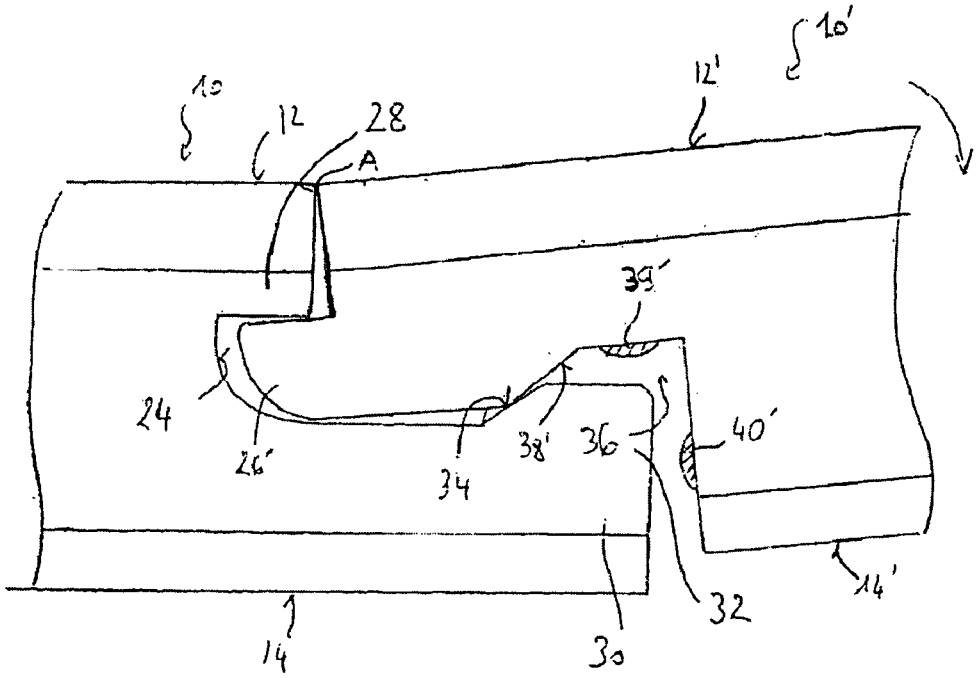
FIG. 2: shows a sectional view illustrating the angular interlocking of two identical floor covering panels in accordance with the variant of FIG. 1.

In the embodiment illustrated in FIGS. 1 to 3, a repositionable glue is used which is deposited in the form of a bead. It preferably comprises a hot-melt glue which is applied hot. Depending their viscosity when hot, such glues may be deposited in the form of beads, films or flattened beads. They are applied by means of guns onto which nozzles of different diameters are fitted. It will be noted here that the hot-melt glue is only in contact, when hot, with the surface onto which it is deposited. This glue solidifies and then has a free surface having a tack which brings about immediate adhesion when a certain pressure of the stop 32 is exerted, but does not fix the panels together permanently.

These hot-melt glues are generally based on polyolefins, polyurethane (PU), ethyl vinyl acetate (EVA), polyvinyl acetate (PVAC), polyvinyl butyral (PVB), etc. In the case of an application with HDF coupling means, it is possible to use the hot-melt glue known under the name INSTAWELD 6615 E (manufactured by NATIONAL Starch & Chemical).

It is alternatively possible to use glues which can be applied at ambient temperature (e.g. acrylic emulsions). These glues are for example deposited in film form by kiss contact against a cylinder of appropriate dimensions. This type of glue requires larger areas of contact.

It will be noted again that the important factor is that the glue used makes it possible to form an adhesive deposit exhibiting the behaviour of a repositionable adhesive towards the material which will come into contact therewith during interlocking. This type of deposit may possibly be obtained with glues which are not known (sold) as repositionable glues and which therefore also fall within the scope of the present invention.

Figure 4:
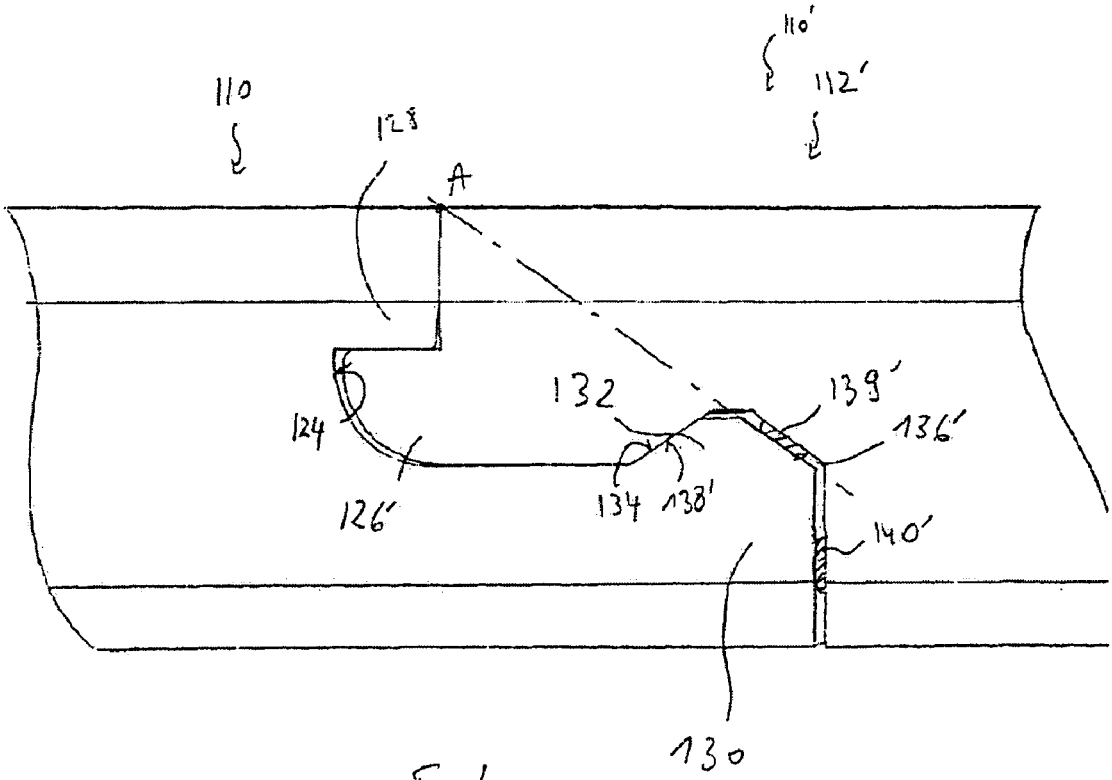
FIG. 4: shows a cross-sectional view through some assembled panels according to the invention having a modified coupling profile. In the figures, identical reference signs denote identical or similar elements.

As indicated above, the geometry of the coupling profile and the position of the beads of glue have an influence on the click effect perceived by the user. FIG. 4 shows a variant of the embodiment of FIGS. 1 to 3, in which the profiles of the stop 132 and the locking channel 136 have been modified to enhance the "click" effect. As can be seen, the surface behind the stop 132 (after the locking surface 134 moving away from the groove 124) is no longer horizontal but is inclined such that its surface falls within a plane passing through A, the top of the edges in contact.

In this configuration, the bonding surfaces are perpendicular to the disassembly direction of the panels, which makes it possible to maximise the disassembly moment required to separate the strips 110 and 110' by rotation in the anticlockwise direction. Thus, for a bead having the same characteristics as is in FIG. 3, the configuration of FIG. 4 makes it possible to intensify the "click" effect.

A larger area is also available for application of the bead.

Finally, the multilayer structure of the panel 10 will be noted which comprises (see FIG. 1) an upper layer 42, a support layer 44 and un a backing 46. In the present variant, the upper layer 42, of solid wood, is laminated onto the support layer. The support layer 44 is of MDF or HDF. The backing 46 is based on resin-impregnated cellulose.

Depending on the application, the upper layer may be a melamine-impregnated decoration (multilayer material) or a ceramics material. The support may be of fibre cement or filled resin or other readily machinable materials. The backing is not always necessary.

The invention claimed is:

1. Panel for surface covering comprising:

a first edge provided with a first coupling means comprising a groove defined by an upper lip and a lower lip;

a second opposite edge provided with a second coupling means comprising a tongue, said coupling means being designed to cooperate so as to enable coupling of two of these panels in an assembly plane;

mechanical locking means integrated into at least one of said first and second coupling means which, when two panels are coupled in the assembly plane, is configured to prevent these panels from moving apart from one another in a direction perpendicular to that of said first and second edges and parallel to said assembly plane;

said first and second coupling means being designed for coupling essentially without elastic deformation thereof;

wherein at least one part of a surface of at least one of said first and second coupling means includes a repositionable adhesive, which is configured to create bonds between said first and second coupling means that are multiply breakable and re-bondable, wherein a breaking of said bonds on disassembly of said panels out of said assembly plane results in a click designed to indicate decoupling to a user said click being a chemical click generated by physicochemical properties of materials in contact.

2. The panel according to claim 1, wherein said lower lip extends beyond said upper lip;

and said mechanical locking means comprise:

a locking element projecting upwards on said lower lip, said locking element having a first locking surface;

a second locking surface on the second coupling means, which surface is capable of cooperating with said first locking surface of a similar panel to prevent displacement perpendicular to said first and second edges and parallel to the assembly plane.

3. The panel according to claim 2, wherein said locking element is located on said lower lip beyond said upper lip in the direction perpendicular to said first and second edges, said second locking surface is defined by a locking channel in said second coupling means, behind said tongue.

4. The panel according to claim 2, wherein said first locking surface exhibits a locking angle of between 35 and 70° relative to a horizontal.

5. The panel according to claim 1, wherein said first and second coupling means are designed such that a tongue of a first panel with a top edge may be inclined in a groove of a second panel with a top edge, and in that a stop of the second panel may be inserted into a locking channel of the first panel by a relative rotational movement between said first and second panels about an axis of rotation corresponding to the tops of the edges in contact.

6. The panel according to claim 5, having a decoupling moment of between 3 and 9 N·m/m.

7. The panel according to claim 1, wherein the repositionable adhesive forms a deposit, a free surface of which exhibits a tack of the order of 0.05 to 0.3 $N/mm^2$.

8. The panel according to claim 1, wherein said repositionable adhesive is included on surfaces facing said first and second coupling means which only come into contact at an end of angular interlocking.

9. The panel according to claim 8, wherein said repositionable adhesive is provided to adhere to a surface of a locking element which falls in a plane passing through an axis of rotation during decoupling.

10. The panel according to claim 5, wherein said repositionable adhesive is provided to adhere to a surface of a locking element which falls in a plane passing through an axis of rotation during decoupling.

11. The panel according to claim 9, wherein said repositionable adhesive is applied onto the second coupling means.

12. The panel according to claim 1, wherein said repositionable adhesive is applied onto the second coupling means.

13. The panel according to claim 11, wherein at least one surface portion of a locking channel is covered with repositionable adhesive, preferably away from a second locking surface.

14. The panel according to claim 1, wherein said repositionable adhesive is a hot-melt glue applied hot in a form of a bead.

15. The panel according to claim 1, having a multilayer structure comprising at least an upper layer and a support layer.

16. The panel according to claim 15, wherein the upper layer is one of a solid wood, a melamine-impregnated decoration, and a ceramics plate.

17. The panel according to claim 15, wherein the support layer is of medium-density fiberboard, high medium-density fiberboard, chipboard, fibre cement or filled resin.

18. Method of covering a surface comprising applying the panel of claim 1.

19. Covering comprising the panels according to claim 1.

20. Method according to claim 18, wherein said surface is a floor surface, a wall surface or a ceiling surface.

21. The panel according to claim 1, wherein the repositionable adhesive forms a deposit, a free surface of which exhibits a tack of 0.15 $N/mm^2$.

22. Panel for surface covering comprising:

a first edge provided with a first coupling means comprising a groove defined by an upper and a lower lip;

a second opposite edge provided with a second coupling means comprising a tongue, said coupling means being designed to cooperate so as to enable coupling of two of these panels in an assembly plane;

mechanical locking means integrated into at least one of said first and second coupling means which, when two panels are coupled in the assembly plane, is configured to prevent these panels from moving apart from one another in a direction perpendicular to that of said first and second edges and parallel to said assembly plane;

said first and second coupling means being designed for coupling essentially without elastic deformation thereof;

wherein at least one part of a surface of at least one of said first and second coupling means includes a repositionable adhesive, which is configured to create bonds between said first and second coupling means that are multiply breakable and re-bondable, wherein a breaking of said bonds on disassembly of said panels out of said assembly plane results in a click designed to indicate decoupling to a user, wherein the repositionable adhesive forms a deposit, a free surface of which exhibits a tack of 0.05 to 0.3 $N/mm^2$.

* * * * *